US007176863B2

(12) United States Patent
Nguyen

(10) Patent No.: US 7,176,863 B2
(45) Date of Patent: Feb. 13, 2007

(54) METHOD AND APPARATUS FOR A FLAT PANEL DISPLAY HAVING REDUCED POWER CONSUMPTION

(75) Inventor: Don Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 313 days.

(21) Appl. No.: 10/131,760

(22) Filed: Apr. 23, 2002

(65) Prior Publication Data

US 2003/0197671 A1 Oct. 23, 2003

(51) Int. Cl.
*G09G 3/36* (2006.01)

(52) U.S. Cl. ..... 345/87; 345/89; 345/95; 345/204; 345/208; 345/96; 345/690; 345/692; 345/693

(58) Field of Classification Search ..... 345/89–100, 345/204–206, 208, 96, 690, 87, 211
See application file for complete search history.

(56) References Cited

U.S. PATENT DOCUMENTS 5,818,402 A * 10/1998 Park et al. ..... 345/58
6,057,820 A * 5/2000 Irwin ..... 345/96
6,166,714 A * 12/2000 Kishimoto ..... 345/96
6,340,963 B1 * 1/2002 Anno et al. ..... 345/92
6,677,925 B1 * 1/2004 Kawaguchi et al. ..... 345/98
6,753,838 B2 * 6/2004 Kuijk et al. ..... 345/89
2002/0041281 A1 * 4/2002 Yanagi et al.
2002/0190942 A1 * 12/2002 Lee ..... 345/96

* cited by examiner

*Primary Examiner*—Richard Hjerpe
*Assistant Examiner*—Jennifer T. Nguyen
(74) *Attorney, Agent, or Firm*—Blakely, Sokoloff, Taylor & Zafman LLP

(57) ABSTRACT

A flat panel display is described having a matrix of liquid crystals, wherein the liquid crystals have a common node. A pair of voltages that are applied to the common node help determine the rms voltages that are applied to the liquid crystals. The pair of voltages are tailored to bring a maximum rms voltage that is applied to the liquid crystals so as to fall along the lower knee of a transmittance vs. rms voltage curve that characterizes the performance of the liquid crystals.

17 Claims, 9 Drawing Sheets

(TRANSMISSIVE DISPLAY)

(REFLECTIVE DISPLAY)

(TRANS-REFLECTIVE)

METHOD AND APPARATUS FOR A FLAT PANEL DISPLAY HAVING REDUCED POWER CONSUMPTION

FIELD OF INVENTION

The field of invention relates generally to flat panel display technology; and, more specifically, to a method and apparatus for a flat panel display having reduced power consumption.

BACKGROUND

A flat panel display (which may also be referred to as a "liquid crystal display" (LCD), "flat panel", and the like) is often used as the "screen" for mobile electronic products such as laptop computers and wireless handheld devices (e.g., cellular telephones, personal digital assistants (PDAs), etc.). A flat panel display typically comprises a matrix of liquid crystal elements that affect the optical contrast(s) presented to a viewer of the flat panel display. The optical contrast(s) are affected in response to one or more electronic signals that are applied to the liquid crystal elements.

FIGS. 1*a* through 1*c* show possible types of flat panels that are liquid crystal based. FIG. 1*a* shows a "transmissive" flat panel display $\mathbf{101}_a$, FIG. 1*b* shows a "reflective" flat panel display $\mathbf{101}_b$; and, FIG. 1*c* shows a "trans-reflective" flat panel display $\mathbf{101}_c$. According to the "transmissive" flat panel display approach of FIG. 1*a*, electronic signals are directed to the liquid crystals that effectively modulate the amount of light emitted by the liquid crystals so as to present an overall image to a viewer of the flat panel display. Here, an "internal" light source (referred to as a backlight $\mathbf{104}_a$) acts as a light source. The transparencies of the liquid crystals are individually modulated by the electronic signals such that the more transparent a liquid crystal becomes, the more light it emits from the perspective of a viewer of the flat panel display.

According to the "reflective" flat panel display approach of FIG. 1*b*, electronic signals are directed to the liquid crystals that effectively modulate their reflectivity. Here, an external light source $\mathbf{102}_b$ is the optical basis for forming an image. The modulated reflectivity of the flat panel $\mathbf{101}_b$ is able to help form an image by reflecting the optical energy from the external light source $\mathbf{102}_b$ at varying percentages over the surface of the flat panel in accordance with the modulating electronic signals.

The "trans-reflective" flat panel display of FIG. 1*c* combines the approaches observed in both FIGS. 1*a* and 1*b*. That is, electronic signals are used to modulate both the optical emission and the optical reflection of the liquid crystals in order to present an overall image to a viewer of the flat panel display. Regardless as to which type of flat panel display technology is used, a liquid crystal may be characterized in terms of its "transmittance".

Here, higher transmittance corresponds to more light as observed by the viewer; and, lower transmittance corresponds to less light observed by the viewer. Thus, in the case of a "transmissive" display, higher transmittance corresponds to more light emitted by a liquid crystal (i.e., greater transparency); in the case of a "reflective" display, higher transmittance corresponds to greater liquid crystal reflectivity; and, in the case of a "trans-reflective" display, higher transmittance corresponds to more light emitted by a liquid crystal and greater liquid crystal reflectivity.

Flat panel displays are often classified as "active" or "passive". An active flat panel display matrix typically includes a transistor coupled to each liquid crystal that "drives" its corresponding liquid crystal. A passive flat panel display matrix omits the aforementioned transistor. FIG. 2*a* shows an embodiment of a circuit model for an active flat panel display "dot". A dot is the basic unit of transmission in a flat panel display; and, therefore, a dot includes a liquid crystal element. A pixel typically comprises three "dots": one red dot, one green dot, and one blue dot. According to the circuit model of FIG. 2*a*, the liquid crystal dot is represented as a capacitor "C". The transistor "Q", as is consistent with the aforementioned description of an active flat panel display, is configured to drive the liquid crystal C.

As flat panel displays are usually organized into a matrix having rows and columns, one transistor node is coupled to a device that drives the row to which the dot circuit belongs; and, another transistor node is coupled to a device that drives the column to which the dot circuit belongs. In the dot circuitry example of FIG. 2*a*, the row driver is coupled to the transistor's gate node 212 and the column driver is coupled to the transistor's drain node 211.

The transistor Q is turned "on" or "off" in response to the row node 212 voltage. When the row node 212 voltage is sufficient to turn the transistor Q "on", the transistor Q effectively acts as a short circuit. This allows the voltage applied at the column node 211 to appear at the capacitor C electrode that is opposite the common node 213. Hence, the voltage across the capacitor Vc is approximately equal to the difference between the column node 211 voltage and the common node 213 voltage.

The transmittance of the liquid crystal C depends upon the root-mean-square (rms) of the voltage Vc that is applied across the liquid crystal. FIG. 2*b* shows some exemplary waveforms that are consistent with present day applications. Firstly, a common voltage 203 (that is applied at common node 213 of FIG. 2*a*) alternates between a pair of voltages. Although not a strict requirement, the common voltage is often made to alternate between a positive voltage (e.g., +7 v) and a negative voltage (e.g., −2 v). Hence, the common voltage 203 is often regarded as alternating over time between a pair of phases: 1) a positive phase where the common voltage is positive (one of which is shown as being over time period 210 in FIG. 2*b*); and 2) a negative phase where the common voltage is negative (one of which is shown as being over time period 211 in FIG. 2*b*).

The column voltage 201 is crafted, when the transistor is "on", so as to create a specific rms voltage across the capacitor C (so that a specific transmittance is associated with the liquid crystal C) in light of the alternating common voltage 203. For example, as seen in FIG. 2*b*, during the positive phase(s), the column voltage is +2 v; and, during the negative phase(s), the column voltage is +3 v. Thus, also as seen in FIG. 2*b*, during the positive phase(s) Vc=−5 v (i.e., 2 v−7 v=−5 v); and, during the negative phase(s) Vc=+5 v (i.e., 3 v−(−2 v)=+5 v). As such, for the exemplary embodiment of FIG. 2*b*, the rms voltage for the voltage across the capacitor is 5 v. As mentioned above, the transmittance of the liquid crystal C depends upon the root-mean-square (rms) of the voltage that is applied across it. FIG. 3 shows an exemplary depiction 301 of the transmittance as a function of the applied rms voltage.

FIGURES

The present invention is illustrated by way of example and not limitation in the figures of the accompanying drawings, in which like references indicate similar elements, and in which:

FIG. 1*a* shows a depiction of a transmissive flat panel display

FIG. 1*b* shows a depiction of a reflective flat panel display.

FIG. 1*c* shows a depiction of a trans-reflective flat panel display.

FIG. 2*a* shows an embodiment of a liquid crystal "dot" circuitry.

FIG. 2*b* shows an embodiment of waveforms that may be observed upon the dot circuitry of FIG. 2*a*.

FIG. 3 shows an embodiment of transmittance vs. applied rms voltage for a liquid crystal.

FIG. 4*a* shows an embodiment of a region of operation for a liquid crystal that may be designed into a flat panel display application.

FIG. 4*b* shows a depiction of a lower knee region for a transmittance vs. rms voltage curve.

FIG. 4*c* shows waveforms that may be applied to the dot circuitry of FIG. 1 wherein a reduced common voltage swing has been employed in order to limit the operable range of the liquid crystal.

DETAILED DESCRIPTION

Figure 3:
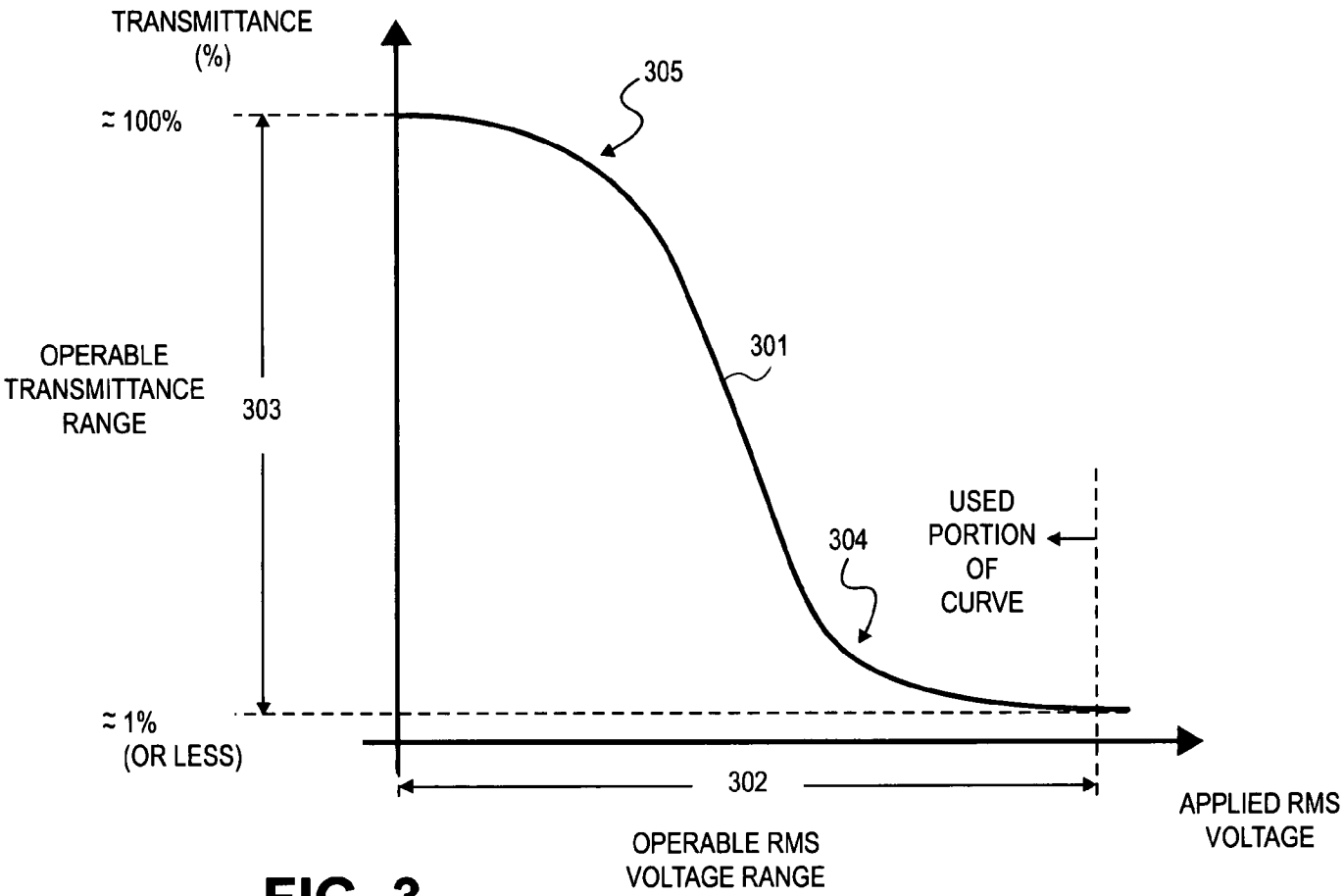
FIG. 3 (PRIOR ART)

FIG. 3 displayed an embodiment of transmittance vs. applied rms voltage for a liquid crystal. In prior art solutions, the flat panel display electronics are designed to provide a wide range of operable rms voltages 302 to each liquid crystal within the display matrix. As a result, the liquid crystals within the display matrix are each configured so as to be operable over a wide range 303 of optical transmissions.

As seen in FIG. 3, the transmittance vs. applied rms voltage curve 301 is typically characterized by an upper knee 305 and a lower knee 304. In order to achieve the wide operable optical transmission range 303, the display electronics are often configured to extend the region of operable applied rms voltages 302 beyond the lower knee 304 (moving from left to right along the curve 301). Extending the region of operable applied rms voltages 302 beyond the lower knee 304 allows the liquid crystals to reach very low transmissions (e.g., 1% or less as seen in FIG. 3). As such, various shades of "black" may be presented on the display.

A problem, however, is that relatively large rms voltages are used to reach those transmissions beyond the lower knee 304. Notably, at least for battery powered devices (such as the mobile products described in the background), the use of large rms voltages can limit the operable lifetime of the battery used to power the device. Furthermore, the actual utility of having the ability to display various shades of "black" is marginal for most all applications.

Figure 4A:
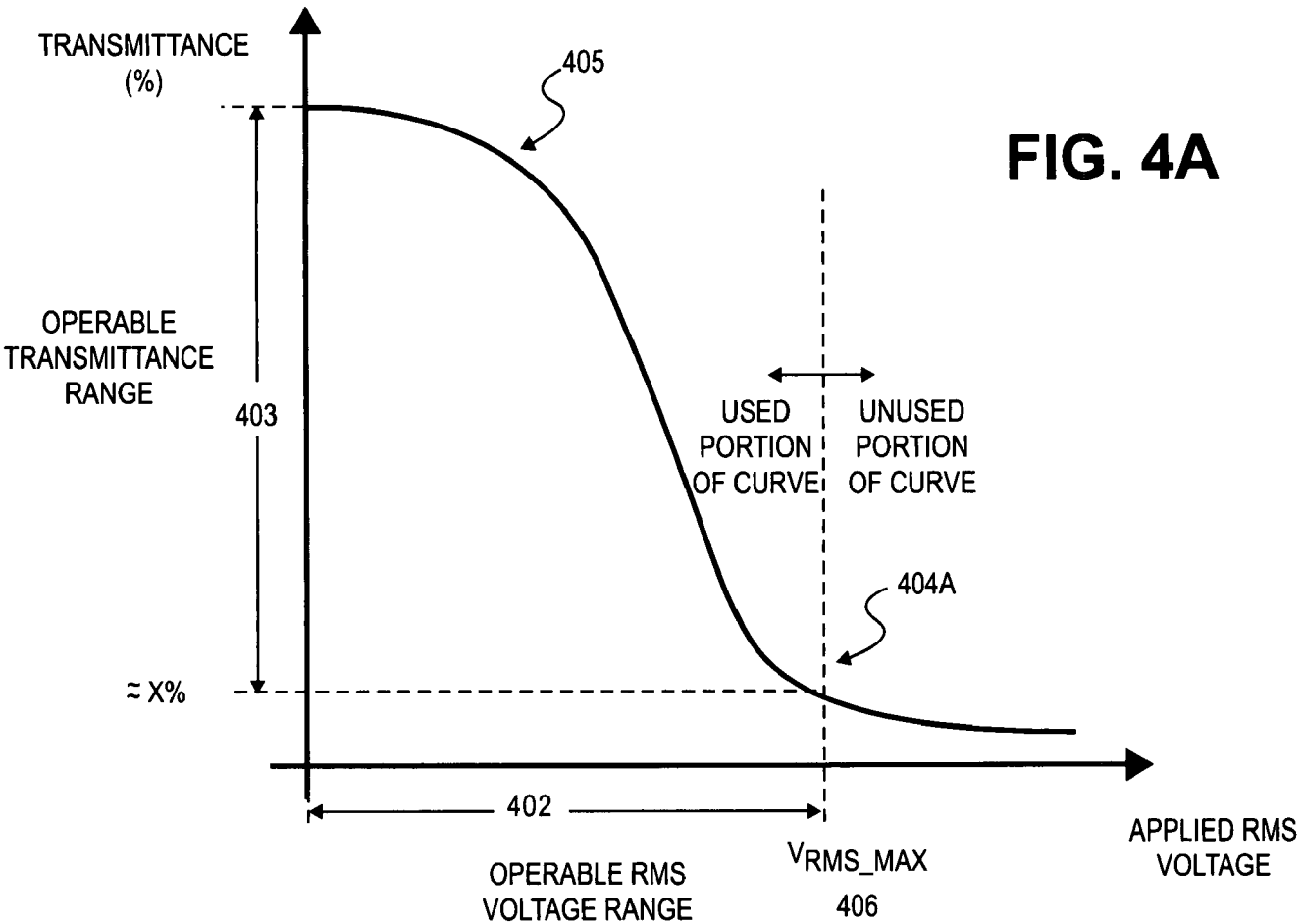

A better design point is to limit the region of liquid crystal operation such that the use of high rms voltages is avoided. An example is observed in FIG. 4*a*. In the embodiment of FIG. 4*a*, the region of operation is kept to the region of the curve 401 that is within and to the "left" of an operating position 404*a* that falls within the lower knee region. That is, the region of operable rms voltages 402 that may be applied to the liquid crystal device(s) is limited so as not to exceed a maximum rms voltage 406, where the maximum rms voltage is along the transmittance curve's lower knee region.

By so doing, the operable range 403 of optical transmittances is similarly narrowed (as compared to the prior art approach of FIG. 3). Nevertheless, because of the shape of the transmittance vs. rms voltage curve 405, the operable transmission range 403 is still sufficiently wide for most (if not all) applications. As such, a sufficiently wide operable transmission range 403 has been achieved; yet, the use of high rms voltages has been avoided. As a result, mobile products can enjoy extended per-battery lifetimes while maintaining sufficient performance from the liquid crystal display.

As seen in FIG. 4*a*, the maximum rms voltage 406 is such that the minimum transmittance is X %. X can vary from embodiment to embodiment (e.g., 0%, 10%, 20%, 30%, 40%, etc.,) depending on the particular transmittance curve and maximum applied rms voltage. For typical liquid crystal display units that are currently being manufactured, an appropriate maximum rms voltage 406 may be 5 v or less. Notably, for prior art approaches, it is common practice to extend the maximum rms voltage to 7.0 v or beyond.

Furthermore it is important to note that, for example, if technical improvements have been or will be made to LCD technology so as to improve their optical efficiency such that the lower knee region of the transmittance vs. applied rms voltage curve 401 corresponds to voltages less than 5 v. As such, the claims that follow are not to be automatically construed as being limited to a lower knee region having within it's range an applied rms voltage of 5 v as suggested in the preceding paragraph.

Figure 4B:
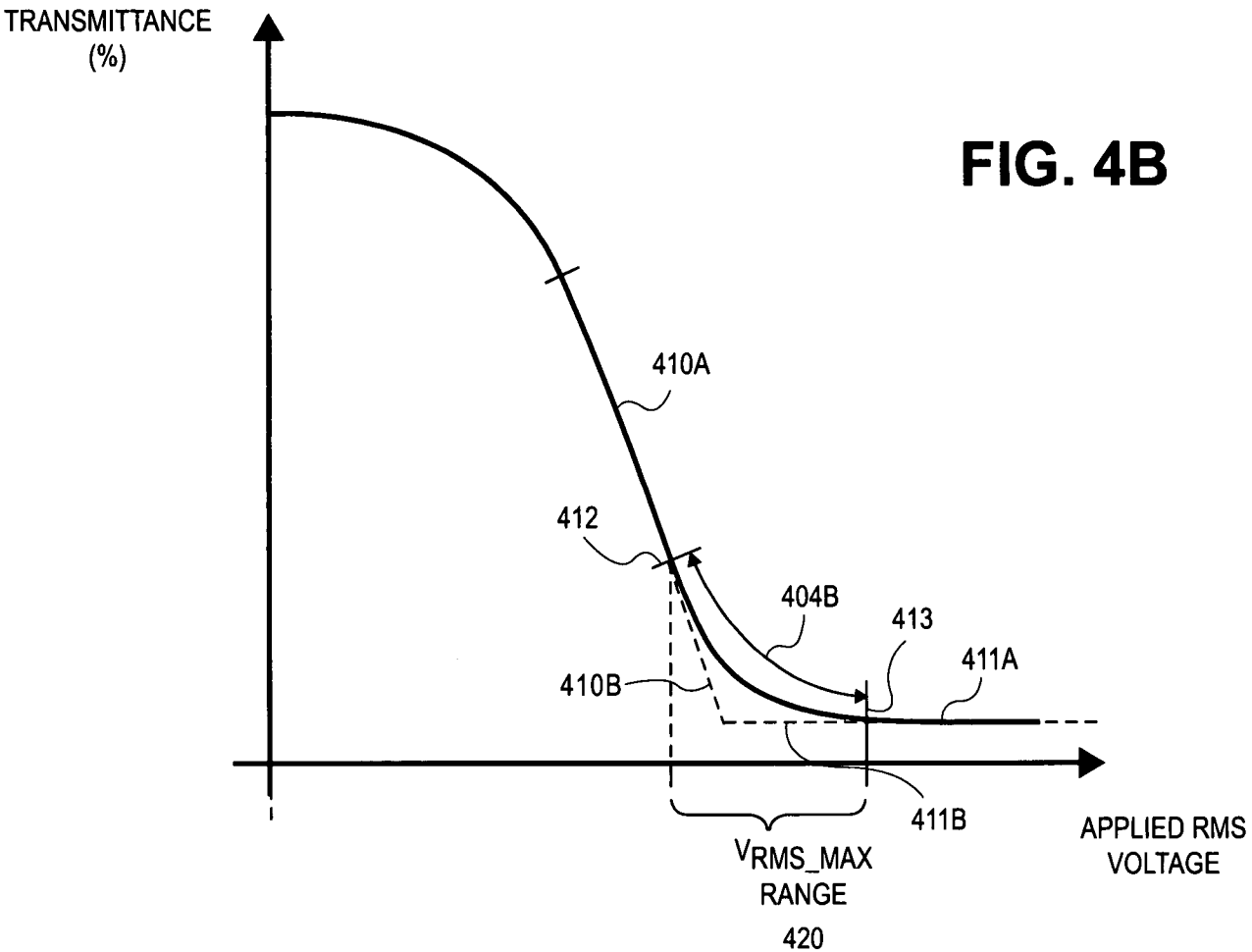

FIG. 4*b* provides a depiction of a lower knee region 404*b*. Note that the transmittance vs. applied rms voltage curve can be viewed as being constructed with a first linear region 410*a* (i.e., first region 410*a* that to the naked eye appears to be more like a straight line than like a curve) that describes a dramatic drop in transmittance per increment in applied rms voltage; and, a second linear region 411*a* that describes a negligible drop in transmittance per increment in applied rms voltage.

The first linear region 410*a* is made more apparent in FIG. 4*b* by its being effectively extended with dashed line segment 410*b*. Similarly, the second linear region 411*a* is made more apparent in FIG. 4*b* by its being effectively extended with dashed line segment 411*b*. Here, the two linear regions 410*a* and 411*a* are "connected" by the lower knee region 404*b*. Thus, a knee region is a region of a transmittance curve that connects a pair of linear regions as described above.

Here, a first knee region endpoint 412 corresponds to the section of the curve where the first linear region 410*a* begins to noticeably depart from being a line (e.g., as observed by the curve's deviation from extended line region 410*b*). A second knee region endpoint 413 corresponds to the section of the curve where the second linear region 411*a* begins to noticeably depart from being a line (e.g., as observed by the curve's deviation from extended line region 411*b*). The region of the curve between these two endpoints corresponds to the lower knee region 404*b* of the curve. Accordingly, designing the maximum rms voltage anywhere within range 420 would correspond to designing the display such that the maximum rms voltage falls within the lower knee region 404*b*.

Figure 1A:
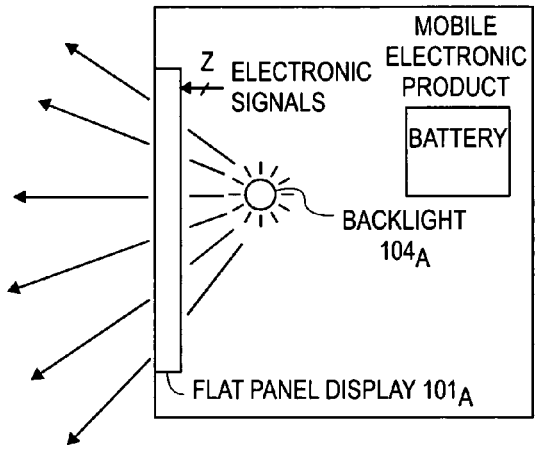
FIG. 1A (PRIOR ART)
Figure 1B:
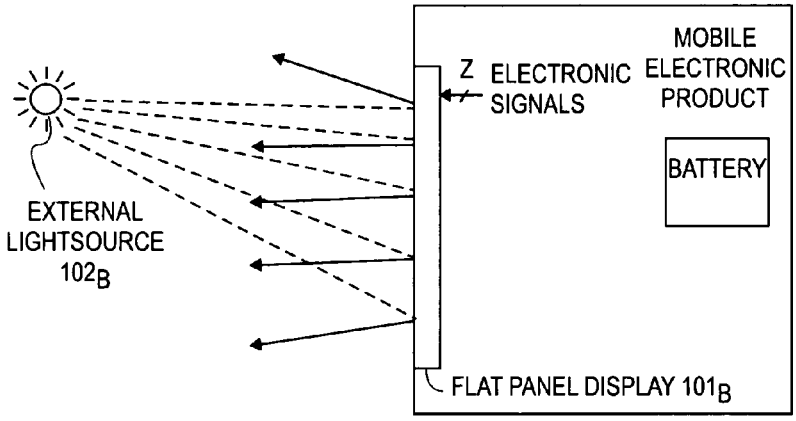
FIG. 1B (PRIOR ART)
Figure 1C:
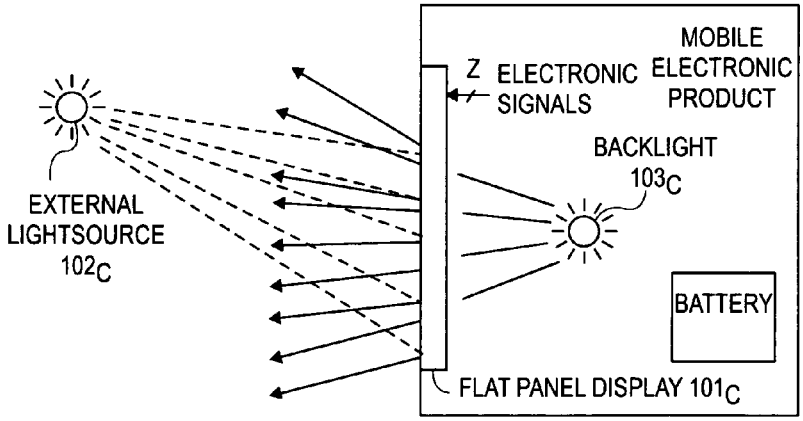
FIG. 1C (PRIOR ART)
Figure 4C:
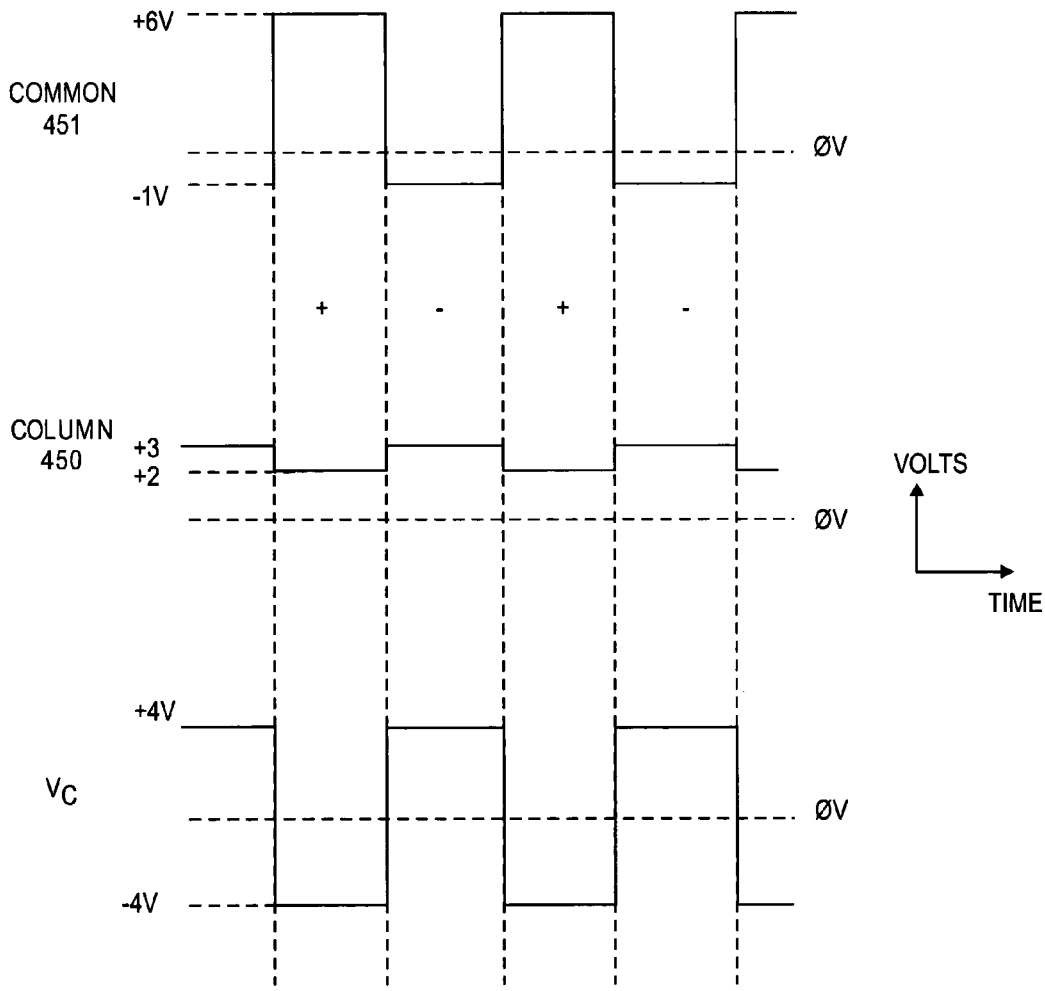

FIG. 4*c* shows how the applied rms voltage can be lowered by reducing the range of the common voltage that is applied to the dot circuit of FIG. 1. For example, comparing the waveforms of FIG. 4*c* to the waveforms of FIG.

Figure 2A:
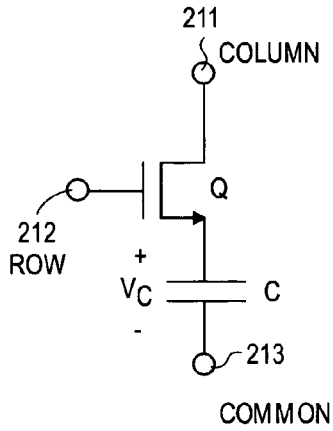
FIG. 2A (PRIOR ART)
Figure 2B:
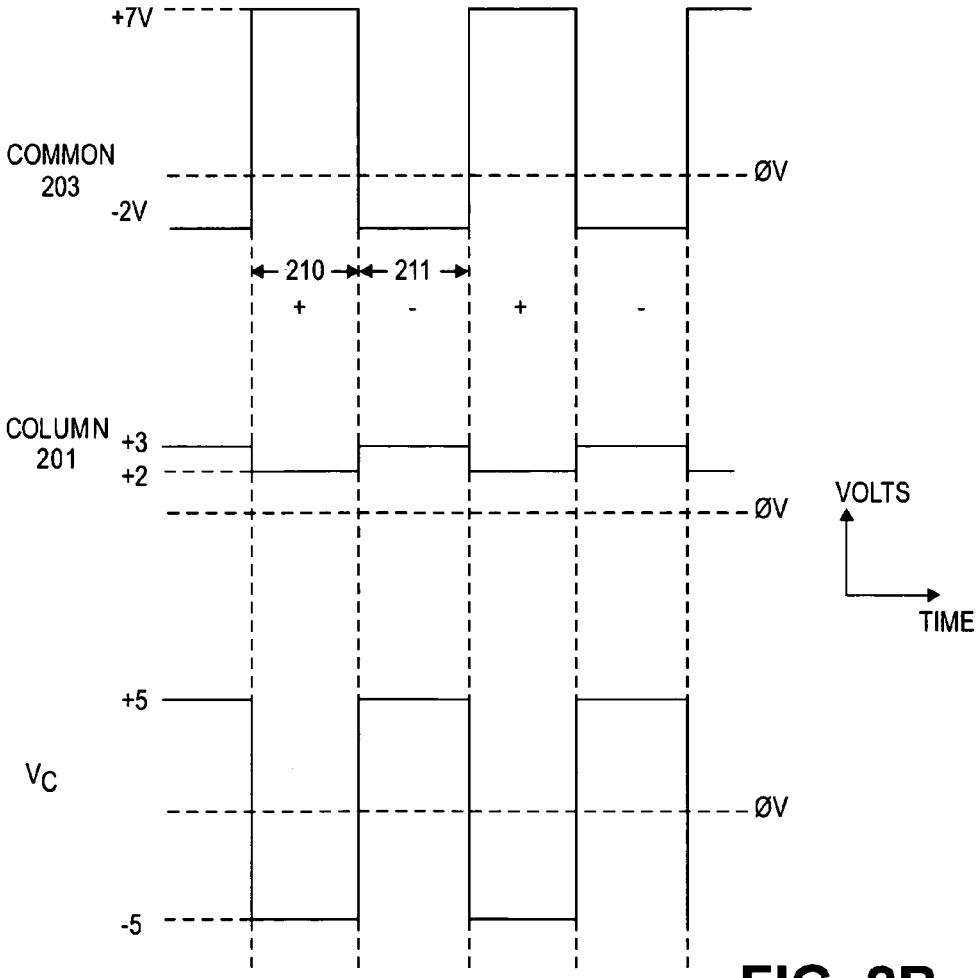
FIG. 2B (PRIOR ART)

2*b*, note that the same column voltage 201, 450 is being applied (i.e., +3 v during the negative phase and +2 v during the positive phase); but, the common voltage 451 being applied in FIG. 4*c* has a lowered voltage range (i.e., +6 v to −1 v) than the common voltage 203 being applied in FIG. 2*b* (i.e., +7 v to −2 v).

As a result, a lower applied voltage Vc is observed in FIG. 4*c* (i.e., +4 v in the positive phase, −4 v in the negative phase) as compared to FIG. 2*b* (i.e., +5 v in the positive phase, −5 v in the negative phase). Specifically, for the same column voltage waveforms 203, 450, the applied rms voltage is 4 v in the approach of FIG. 4*c* as opposed to 5 v in the approach of FIG. 2*b*. As such, reducing the span of the common voltage results in a lowered rms voltage.

This characteristic can be taken advantage of to cost effectively introduce a reduced liquid crystal operating range (e.g., as observed in FIG. 4*a*) into the electronics design of a liquid crystal display. That is, as current "off-the-shelf" (or other) semiconductor integrated circuits (ICs) used for driving the column voltage(s) of a liquid crystal display are designed to supply a wide range of rms voltages (e.g., as observed in with respect to rms voltage range 302 of FIG. 3), complications can arise if one chooses to reduce the applied rms voltages to the liquid crystals via a reduction in the column voltages. By contrast, according to the approaches described herein, a reduced range of applied rms voltages can be achieved even if the column driver circuitry is designed to operate "as if" a wider range of applied rms voltages is to be applied to the liquid crystals.

Figure 5:
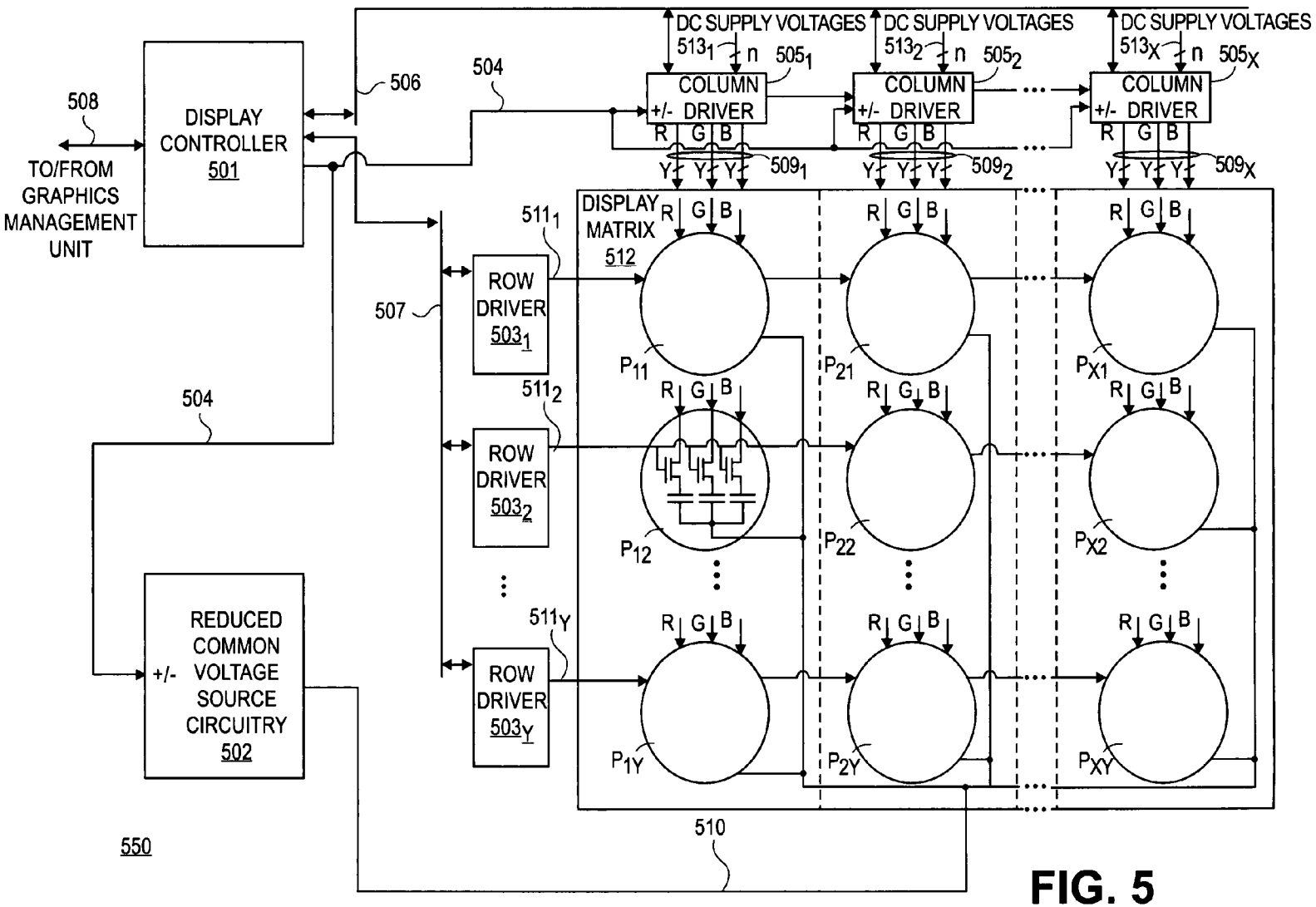
FIG. 5 shows an embodiment of a flat panel display design that can be used to limit the region of operation of the liquid crystal in accordance with the approach observed in FIG. 4*a*.

This point can be made more clearly by referring to FIG. 5. FIG. 5 shows an embodiment of a design for a flat panel display driver circuit 550 that can be used to limit the region of operation of the liquid crystal without having to change the design or operating environment of the column drivers $\mathbf{505}_1$ through $\mathbf{505}_x$ (as compared to those approaches having a wide applied rms voltage range). Further still, as described in more detail below, the graphics data that is sent to the column drivers does not need to be altered in order to reduce the applied rms voltages to the liquid crystals. Before continuing it is important to note that those of ordinary skill will be able to design flat panel display driver circuits that are different than the specific design approach observed in FIG. 5.

According to the flat panel display driver circuit 550 of FIG. 5, a liquid crystal display 512 having a matrix (or array) of liquid crystal pixels (or simply "pixels") $P_{11}$ through $P_{XY}$ is designed to interface to a plurality of row drivers $\mathbf{503}_1$ through $\mathbf{503}_Y$ and a plurality of column drivers $\mathbf{505}_1$ through $\mathbf{505}_X$ such that each pixel receives a row signal and a column signal from its corresponding row driver and column driver, respectively. For example, pixel $P_{12}$ receives a row signal from row driver $\mathbf{503}_2$ and a column signal from column driver $\mathbf{505}_1$. For simplicity one column driver is shown per column and one row driver is shown per row. It is important to point out that in other embodiments there can be more than one column per column driver and/or more than one row per row driver.

For color displays, each pixel typically contains three liquid crystals: one for the color red ("R"), one for the color green ("G") and one for the color blue ("B"). Pixel $P_{12}$ is drawn to show a representation of these crystals (as well as the corresponding "dot" circuit for each). As such, in the particular embodiment of FIG. 5, each column driver $\mathbf{505}_1$ through $\mathbf{505}_X$ is designed to drive a plurality of output signals ($\mathbf{509}_1$ through $\mathbf{509}_x$, respectively) wherein each pixel along its particular column individually receives a trio of column signals. As such, if there are Y pixels in a column, each column driver has at least 3Y output lines. Note that monochrome displays are often designed according to a similar approach wherein a pixel is designed to include one liquid crystal dot.

According to the embodiment of FIG. 5, the display controller 501 controls the timing and synchronization of the drivers; and, "relays" digital data received from a graphics management unit (e.g., a processing core that executes instructions in order to implement a software routine (such as a microprocessor) and/or a graphics controller) toward the column drivers $\mathbf{505}_1$ through $\mathbf{505}_X$. The graphics management unit is responsible for generating the content of the "picture" to be displayed (e.g., such as a graphical user interface (GUI)) and the digital data that serves as its representation in a digital form).

In an embodiment, the display is freshly "lit up" one row at a time. That is, the column drivers $\mathbf{505}_1$ through $\mathbf{505}_X$ receive digital data from the display controller 501 (e.g., along bus 506) for each pixel in an entire row (e.g., pixels $P_{11}$ through $P_{X1}$). The appropriate column voltages are presented at the column driver outputs (e.g., so that pixels $P_{11}$ through $P_{X1}$ receive their appropriate column signal) and the row is enabled (e.g., by enabling row driver $\mathbf{503}_1$ via an assertive signal from the display controller along communication line 507). As such, each of the pixels within a row are lit up. The process then repeats for a next row (e.g., column drivers $\mathbf{505}_1$ through $\mathbf{505}_X$ are loaded with new data for pixels $P_{12}$ through $P_{X2}$).

It is worthwhile to note that specific column voltages are established by the column drivers $\mathbf{505}_1$ through $\mathbf{505}_X$, in response to the digital data being relayed by the display controller 501, in order to apply an "appropriate" rms voltage to the liquid crystal(s). Under prior art solutions, for some of the digital values (e.g., the digital values having a higher numeric value), the combination of the common node 510 voltage and the specific column voltages result in an applied rms voltage that extends beyond the lower knee in the transmittance vs. rms voltage curve. As such, under these prior art solutions, a wide operable range of rms voltages is applied (e.g., as observed in FIG. 3).

In order to allow for a reduced operable range of applied rms voltages (e.g., as observed in FIG. 4), one could modulate the digital data so that the use of those data values that correspond to higher rms voltages (e.g., the higher digital data values) is avoided. Alternatively, one could reduce the voltage of each of the plurality of DC supply voltages $\mathbf{513}_1$ through $\mathbf{513}_X$ that are presented to the column drivers. The column drivers $\mathbf{505}_1$ through $\mathbf{505}_X$ each receive a plurality of DC supply voltages $\mathbf{513}_1$ through $\mathbf{513}_X$ (e.g., typically 8 or 9 separate DC voltages) from which the specific column voltages are crafted. Thus, the applied rms voltages to the liquid crystals could also be reduced by lowering the DC supply voltages $\mathbf{513}_1$ through $\mathbf{513}_X$.

Note, however, that the former solution (i.e., modulating the digital data) requires overhead in the form of additional digital signal processing (e.g., within the graphical management unit and/or the display controller 501) that effectively screens or re-interprets the digital data so that certain digital values (e.g., the higher digital data values) are not presented to the column drivers $\mathbf{505}_1$ through $\mathbf{505}_X$. With respect to the alternate solution (i.e., lowering the applied DC supply voltages $\mathbf{513}_1$ through $\mathbf{513}_X$), a plurality of DC supply voltages (e.g., 8 or 9 separate DC voltage sources) would have to be lowered.

As the components from which display units are typically manufactured (e.g., the control units, the column drivers, the row drivers, the DC voltage sources that are supplied to the column drivers, etc.) are high volume commodity parts, introducing a change to any of these (to allow for a reduced operable rms voltage range) risks the implementation of a cost-ineffective design. As such, it is helpfull if a display having reduced rms voltages can be designed that introduces minimal change to existing designs or components. As such, the ability to lower the applied the rms voltage via a reduction in the common node 510 voltage is an attractive solution.

Referring to FIG. 5, note that the common node 510 is coupled to the common node of each pixel. The common node 510 is also often referred to as the backplane node 510. By driving the common node 510 with the reduced common voltage source circuitry 502, a reduced common node voltage can be employed which effectively implements a reduced rms voltage range to the liquid crystals (e.g., as demonstrated with respect to FIG. 4*c*). Those of ordinary skill will be able to tailor the specific common node 510 voltage that aligns the maximum rms voltage within the lower knee region of the transmittance vs. rms voltage curve.

Note also that, in the display embodiment 550 of FIG. 5, the reduced common node voltage circuitry 502 receives a "+/−" signal 504 from the display controller 501. The "+/−" signal 504 indicates whether the positive phase or the negative phase is applicable. Thus, if the positive phase is applicable, the reduced common node voltage circuitry supplies a reduced positive supply voltage; and, if the negative phase is applicable, the reduced common node voltage circuitry 502 supplies a reduced negative supply voltage.

Figure 6:
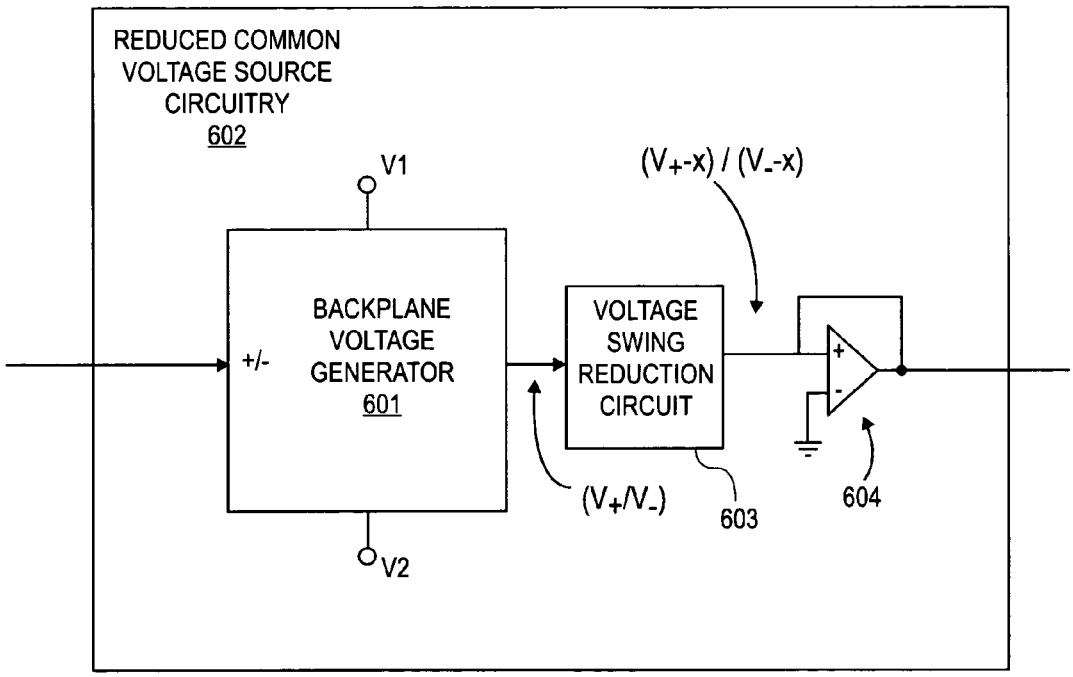
FIG. 6 shows an embodiment of reduced common node voltage source circuit.

FIG. 6 shows a circuit 602 that may be viewed as an embodiment for the reduced common node voltage circuitry 502 of FIG. 5. The reduced common node voltage circuitry 502 includes a backplane voltage generator 601 that is powered by a first DC supply voltage V1 and a second DC supply voltage V2. In an embodiment, the first and second voltages V1 and V2 as well as the backplane voltage generator 601 correspond to a "legacy" design that, by itself, issue a positive voltage V+ and negative voltage V− (depending on the status of the "+/−" signal) that would provide for a wide range of applied rms voltages (e.g., as observed in FIG. 3) if applied directly to the common node of the display matrix).

For example, in an embodiment where common node voltages of +7v and −2v would provide for a wide range of applied rms voltages, the backplane voltage generator 601 is configured to provide output voltages of +7v and −2v. A voltage swing reduction circuit 603 that subtracts a fixed voltage "x" from the positive generator 601 output voltage V+ and adds the same amount of fixed voltage to the negative generator 601 output voltage V− is coupled to the generator 601 output to implement the "reduction" in the common node voltage.

For example (continuing with the above example where a wide rms voltage range of +7 v and −2v is supplied by the generator 601), if the fixed voltage "x" that is subtracted from/added to the positive/negative output voltages of generator 601 is 1.0 v, the voltage swing reduction circuit 603 output will be +6 v for the positive phase and −1v for the negative phase. The output of the divider circuit 603 is coupled to the input of a voltage follower circuit 604 which drives the voltages provided by the voltage swing reduction circuit 603 to the common nodes of the liquid crystals while supplying more current than the generator 601 and/or divider 603 could provide by themselves.

Note that the generator 601 and voltage follower 604 might have been previously implemented by themselves as a "legacy" design that provided for a wide range of rms voltages (e.g., via a common node voltage swing of +7v and −2v). Here by inserting the voltage swing reduction circuit 603 between the generator 601 and follower 604, the reduced rms voltage range is achieved as desired (e.g., wherein the maximum rms voltage that can be applied falls within the lower knee of the transmittance vs. rms voltage curve); and, little expense or modification (in the form of the voltage swing reduction circuit 603) has been added to the legacy display design in order to achieve the desired effect. It is important to note that a wealth of other designs for the reduced common node voltage circuitry 502 can be configured by those of ordinary skill that differ from the specific approach observed in FIG. 6.

Figure 7:
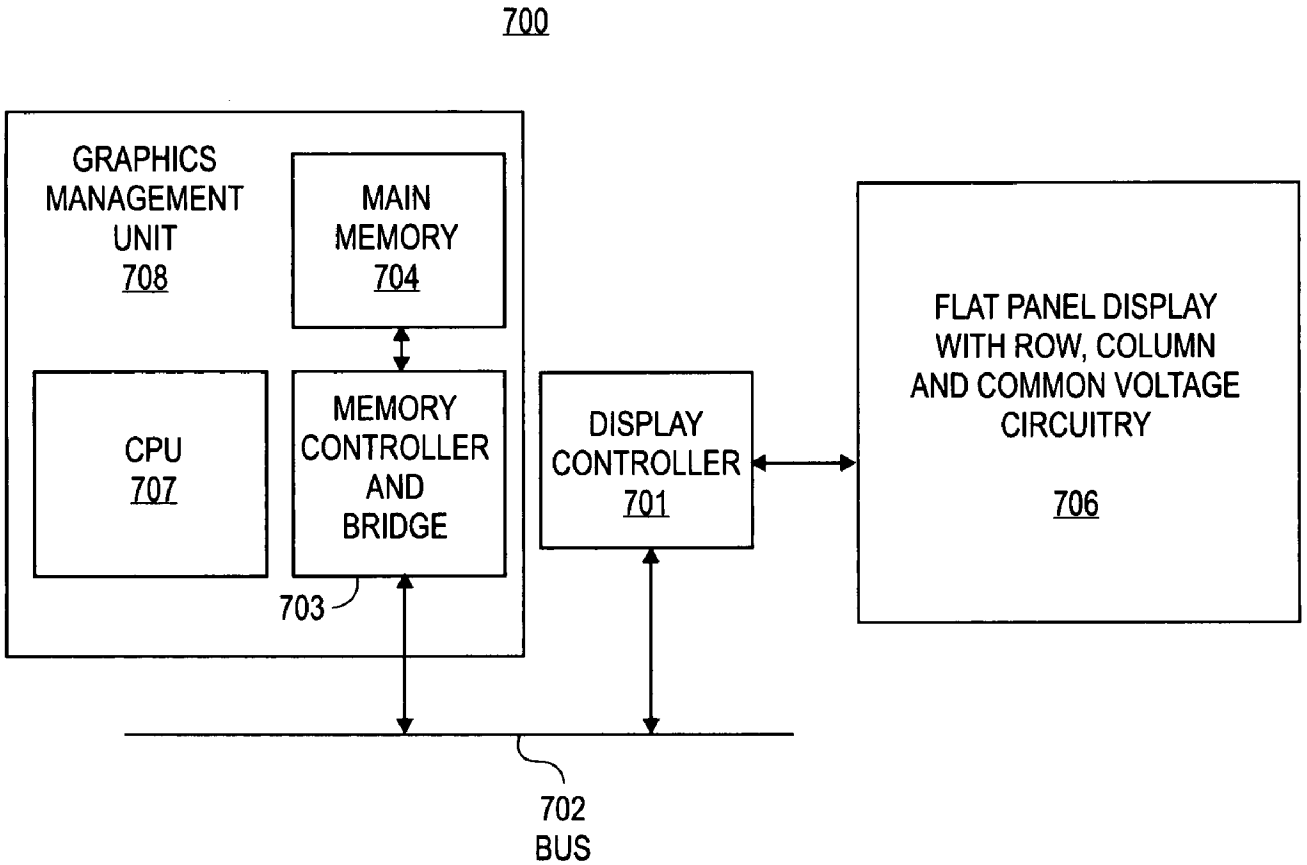
FIG. 7 shows an embodiment of a computing system having a flat panel display.

FIG. 7 shows a computing system 700 that uses a flat panel display 706 having a reduced rms voltage operating range. The computing system includes a graphics management unit 708 that includes a central processing unit (CPU) 707 that executes the software of the system. A bus 702 is coupled to the CPU 707 via a bridge device 703. The bridge device 703 also acts as a memory controller for the main memory 704 of the system 700 (note that one or more ICs may be used to implement the memory control and bridge function). The bus 702 (which, for example, may be implemented as an AGP or PCI bus in various embodiments) handles various input/output signals to/from the CPU 701. The display controller 701 (which may be viewed, for example, as corresponding to display controller 501 of FIG. 5) interfaces to the flat panel display and its row, address and common node driving circuitry 706. In various other embodiments, the communications between the graphics management unit 708 and display controller 701 do not flow through a bridge device 703 (e.g., so that the flat panel display controller 701 communicates directly with the CPU 707 over bus 702). Here, interface 703 may be removed and another interface between the CPU 707 and bus 702 may be added.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. An apparatus, comprising:

a transmissive flat panel display having a matrix of liquid crystals, wherein said liquid crystals have a common node, said apparatus comprising analog common node voltage circuitry connected to said common node to establish a maximum rms voltage applied to said liquid crystals that falls along the lower knee of a transmittance vs. rms voltage curve that characterizes the performance of said liquid crystals, wherein said analog common node voltage circuitry provides an alternating pair of voltages to apply to said common node, wherein, said analog common node voltage circuitry comprises:

a) a first circuit to provide a second alternating pair of voltages that, if applied to said common node, would provide for a larger rms voltage applied to said liquid crystals than provided for by said pair of alternating pair of voltages;

b) a second circuit to reduce the peak-to-peak amplitude of said second alternating pair of voltages to produce said alternating pair of voltages.

2. The apparatus of claim 1 wherein said alternating pair of voltages further comprises a positive voltage and a negative voltage, and, said analog common node voltage circuitry has an input node to receive a +/− signal that indicates whether said positive voltage or said negative voltage is to be applied to said liquid crystals.

3. The apparatus of claim 1 wherein said apparatus further comprises a column driver to drive a column voltage to at least one of said liquid crystals.

4. The apparatus of claim 1 wherein said apparatus further comprises a row driver to drive a row voltage to at least one of said liquid crystals.

5. The apparatus of claim 1 further comprising a display controller to control which of said liquid crystals are to be driven with voltages at a particular moment in time.

6. An apparatus, comprising:

a) a transmissive flat panel display having a matrix of liquid crystals, wherein said liquid crystals have a common node, said apparatus comprising analog common node voltage circuitry connected to said common node to establish a maximum rms voltage applied to said liquid crystals that falls along the lower knee of a transmittance vs. rms voltage curve that characterizes the performance of said liquid crystals, wherein said analog common node voltage circuitry provides an alternating pair of voltages to apply to said common node, wherein, said analog common node voltage circuitry comprises:

i) a first circuit to provide a second alternating pair of voltages that, if applied to said common node, would provide for a larger rms voltage applied to said liquid crystals than provided for by said alternating pair of voltages;

ii) a second circuit to reduce the peak-to-peak amplitude of said second alternating pair of voltages to produce said alternating pair of voltages; and, b) a central processing unit (CPU) coupled to said flat panel display to execute program code that determines content to be displayed on said flat panel display.

7. The apparatus of claim 6 wherein said apparatus is a mobile product capable of being powered by a battery.

8. The apparatus of claim 7 wherein said mobile product is a laptop computer.

9. The apparatus of claim 7 wherein said mobile product is a handheld device.

10. The apparatus of claim 9 wherein said handheld device comprises a handheld phone.

11. The apparatus of claim 9 wherein said handheld device comprises a personal digital assistant.

12. The apparatus of claim 6 wherein said alternating pair of voltages further comprises a positive voltage and a negative voltage, and, said analog common node voltage circuitry has an input node to receive a +/− signal that indicates whether said positive voltage or said negative voltage is to be applied to said liquid crystals.

13. A method comprising, applying alternating column voltages and alternating common node voltages to a circuit that drives a liquid crystal, said alternating column voltages and said alternating common node voltages producing rms voltages that are applied to said liquid crystal circuit over an operable rms voltage range, said alternating common node voltages tailored by analog common node voltage circuitry to bound said operable rms voltage range so as not to extend beyond a lower knee region of a transmittance vs. rms voltage curve that characterizes the performance of said liquid crystal, wherein said analog common node voltage circuitry performs the following method:

receiving a pair of DC voltages to generate a signal having a maximum peak voltage and a minimum peak voltage, said maximum peak voltage not rising above the higher of said pair of DC voltages, said minimum peak voltage not falling below the lower of said pair of DC voltages;

generating said alternating common node voltages by reducing said signal's peak-to-peak voltage swing.

14. The method of claim 13 wherein said alternating column voltages further comprise a positive voltage and a negative voltage.

15. The method of claim 13 wherein said alternating common voltages further comprise a positive voltage and a negative voltage.

16. A semiconductor chip comprising an analog common node voltage circuit, said analog common node voltage circuit to apply a signal to a common node of a plurality of liquid crystals in a flat panel display, said signal to establish a maximum rms voltage applied to said liquid crystals that falls along the lower knee of a transmittance vs. rms voltage curve that characterizes the performance of said liquid crystals, wherein said signal comprises an alternating pair of voltages, wherein, said analog common node voltage circuitry comprises:

a) first circuit to provide a second alternating pair of voltages that, if applied to said common node would provide for a larger rms voltage applied to said liquid crystals than provided for by said alternating pair of voltages;

b) a second circuit to reduce the peak-to-peak amplitude of said second alternating pair of voltages to provide said alternating pair of voltages.

17. The apparatus of claim 16 wherein said alternating pair of voltages further comprises a positive voltage and a negative voltage, and, said first circuit has an input node to receive a +/− signal that indicates whether said positive voltage or said negative voltage is to be applied to said liquid crystals.

* * * * *